US005651504A

United States Patent [19]

Luig et al.

[11] Patent Number: 5,651,504

[45] Date of Patent: Jul. 29, 1997

[54] VENTED BACKFLOW PREVENTER FOR HOSE-TYPE FAUCET

[75] Inventors: Frank-Thomas Luig, Fröndenberg; Roland Weiss, Iserlohn, both of Germany

[73] Assignee: Friedrich Grohe Aktiengesellschaft, Hemer, Germany

[21] Appl. No.: 490,723

[22] Filed: Jun. 15, 1995

[30] Foreign Application Priority Data

Jun. 29, 1994 [DE] Germany ..... 44 22 729.9

[51] Int. Cl.[6] ..... B05B 1/00

[52] U.S. Cl. ..... 239/571; 239/574; 137/318

[58] Field of Search ..... 239/571, 574, 239/588; 137/217, 218, 526; 4/677

[56] References Cited

U.S. PATENT DOCUMENTS

| | | | |
|---|---|---|---|
| 4,827,538 | 5/1989 | Heimann et al. | 4/192 X |
| 5,103,856 | 4/1992 | Fleischmann | 137/218 |
| 5,170,944 | 12/1992 | Shirai | 239/588 X |
| 5,213,268 | 5/1993 | Gnauert | 239/571 |
| 5,279,324 | 1/1994 | Schütz | 137/218 |
| 5,372,158 | 12/1994 | Berfield | 137/217 |

*Primary Examiner*—Andres Kashnikow
*Assistant Examiner*—Lisa Ann Douglas
*Attorney, Agent, or Firm*—Herbert Dubno; Andrew Wilford

[57] ABSTRACT

A plumbing fixture having a valve supplying water under pressure to an output and a hose outlet having an intake end has a vented backflow preventer having a housing separate from the valve and having an inlet port connected to the valve output and an outlet port connected to the hose intake end. A lower check valve in the housing has a lower seat, an upper seat, and a valve body of density greater than water movable between a lower position sitting on and blocking the lower seat and an upper position sitting on and blocking the upper seat. The housing is formed with an inlet passage leading from the inlet port to the lower seat and an outlet passage leading from between the seats to the outlet port. An upper check valve in the housing above the lower check valve has an upper seat above the lower-valve upper seat and a valve body of a density less than water and movable between an upper position sitting on and blocking the upper-valve upper seat and an upper position clear thereof. The housing is formed with an externally open vent opening into the upper check valve above the upper seat thereof.

11 Claims, 2 Drawing Sheets

VENTED BACKFLOW PREVENTER FOR HOSE-TYPE FAUCET

FIELD OF THE INVENTION

The present invention relates to a backflow preventer. More particularly this invention concerns a vented backflow preventer for a hose-type faucet or the like.

BACKGROUND OF THE INVENTION

A sprayer-type faucet has a valve and an outlet head that normally sits on a faucet arm to give the device the appearance and function of a standard faucet that dispenses water when the associated valve is opened. In addition the head can be pulled from the support arm to work as a sprayer. To this end the head is connected via a flexible hose that extends back down through the arm to the valve, normally forming a loop under the deck to provide some range of movement for the spray head. Such an arrangement is extremely convenient in that it eliminates the need for a separate sprayer attachment and it allows convenient switchover from mobile spray to fixed faucet. It can be used in a standard kitchen sink, in a beauty-shop setting, and or in any type of application where a sprayer might be needed in addition to a faucet.

The primary disadvantage of such a system, as opposed to the standard nonextensible faucet, is that the spray head can be left in the sink, in fact below the surface of the water therein. If the valve is still open and there is a momentary pressure reversal, that is the supply pressure momentarily drops below atmospheric, it is therefore possible for such an arrangement to suck in water from the sink, contaminating the clean water in the supply lines. This possibility is an illegal situation that plumbing codes specifically forbid.

In commonly owned U.S. Pat. No. 5,213,268 a faucet assembly is described that has a housing formed with an inlet port, an outlet port, and a vent port and with a vent passage extending between the inlet and vent ports and a feed passage extending between the outlet port and a location in the vent passage between the inlet and vent ports. An inner valve seat is provided in the vent passage between the location and the inlet port, a vent valve seat is provided in the vent passage between the location and the vent port, and an outer valve seat is provided in the vent passage between the location and the vent seat. An inner valve body is displaceable in the vent passage between an inner end position sitting in the inner seat and blocking flow out of the vent passage through the inlet port and an outer end position sitting in the outer seat and blocking flow from the location to the vent port. Similarly an outer valve body is displaceable in the vent position between an outer end position sitting in the vent seat and blocking flow out of the vent passage through the vent port and an inner end position permitting flow through the vent port. The valve bodies are biased into the respective outer positions. A mixing valve normally feeds water under pressure to the inlet port and thereby presses the inner valve body into the outer position and, in an abnormal pressure-reversal situation, applies a subatmospheric pressure to the inlet port and thereby moves the inner valve into the inner position. A faucet arm on the housing carries a removable spray head and a hose has one end connected to the spray head and an opposite end connected to the outlet port of the housing.

Building the backflow preventer into the valve requires that the valve be fairly bulky. This is frequently undesirable from a design point of view, in particular when the fixture is to be used in a bathroom setting.

In another system described in U.S. Pat. No. 5,279,324 the fixture is provided with a coupling having a chamber, an inlet passage through which fluid may enter the chamber from a supply, an outlet passage through the fluid may exit the chamber and the coupling, and a vent passage in fluid communication with the chamber and having an inlet in communication with ambient atmosphere and an outlet in communication with the chamber. The coupling is provided between the fixture's valve and a hose-connected spray head. A vacuum-breaker check valve is located in the vent passage of the coupling and includes a valve member for closing the vent inlet when pressure in the chamber is greater than pressure at the vent inlet and for opening the vent inlet when pressure in the chamber is less than pressure at the vent inlet.

With this arrangement the check valve can fail or leak and allow backflow into the lines. Even if it is working perfectly some backflow is possible under certain circumstances in the time it takes the check valve under the counter to react.

OBJECTS OF THE INVENTION

It is therefore an object of the present invention to provide an improved backflow preventer for a hose-type faucet.

Another object is the provision of such an improved backflow preventer for a hose-type faucet which overcomes the above-given disadvantages, that is which prevents backflow without fail and that is of simple and attractive design.

SUMMARY OF THE INVENTION

A plumbing fixture having a valve supplying water under pressure to an output and a hose outlet having an intake end has a vented backflow preventer having according to the invention a housing separate from the valve and having an inlet port connected to the valve output and an outlet port connected to the hose intake end. A lower check valve in the housing has a lower seat, an upper seat, and a valve body of density greater than water movable between a lower position sitting on and blocking the lower seat and an upper position sitting on and blocking the upper seat. The housing is formed with an inlet passage leading from the inlet port to the lower seat and an outlet passage leading from between the seats to the outlet port. An upper check valve in the housing above the lower check valve has an upper seat above the lower-valve upper seat and a valve body of a density less than water and movable between an upper position sitting on and blocking the upper-valve upper seat and an upper position clear thereof. The housing is formed with an externally open vent opening into the upper check valve above the upper seat thereof.

Thus with this system the lower valve will close on the lower seat to prevent flow out of the inlet passage whenever pressure below lower-valve body is insufficient to lift its heavier-than-water body up. If flow is low but not sufficient to raise the lower-valve body, the upper valve body will float up and close. If, however, there is a pressure reversal, not only will the lower-valve body be sucked down to close the inlet passage off, but the upper-valve body will drop down to vent the assembly.

According to a further feature of the invention the lower valve body is a glass ball and the upper valve body is a plastic ball, preferably of polypropylene. The preventer can further have a second upper check valve in the housing above the first-mentioned upper check valve and having an upper seat above the first upper-valve upper seat and a valve body of a density less than water and movable between an upper position sitting on and blocking the second upper-valve upper seat and an upper position clear thereof. The housing is formed with an externally open vent opening into the second upper check valve above the upper seat thereof.

Each valve in accordance with this invention includes a guide sleeve fitted in the housing and forming the respective seats. Furthermore the housing comprises an outer tube forming the inlet passage and having an upper end provided with the lower-valve upper seat, and an inner tube received in the outer tube, forming therewith a chamber in turn forming the outlet passage, and having an upper end provided with the lower-valve lower seat. The outer tube is provided with an external screw-thread and with nuts thereon adapted to flank a counter and secure the preventer thereto.

In fact according to the invention the housing is mounted on a counter adjacent the valve and the preventer further has a cover cap engaged over the housing and covering same down to the counter. This cover cap is formed with vent holes and has an inner ring engaged snugly over the housing and an outer skirt engaging down to the counter. The housing, which is made of plastic, is provided with a friction ring engaging the inner ring of the cover cap.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
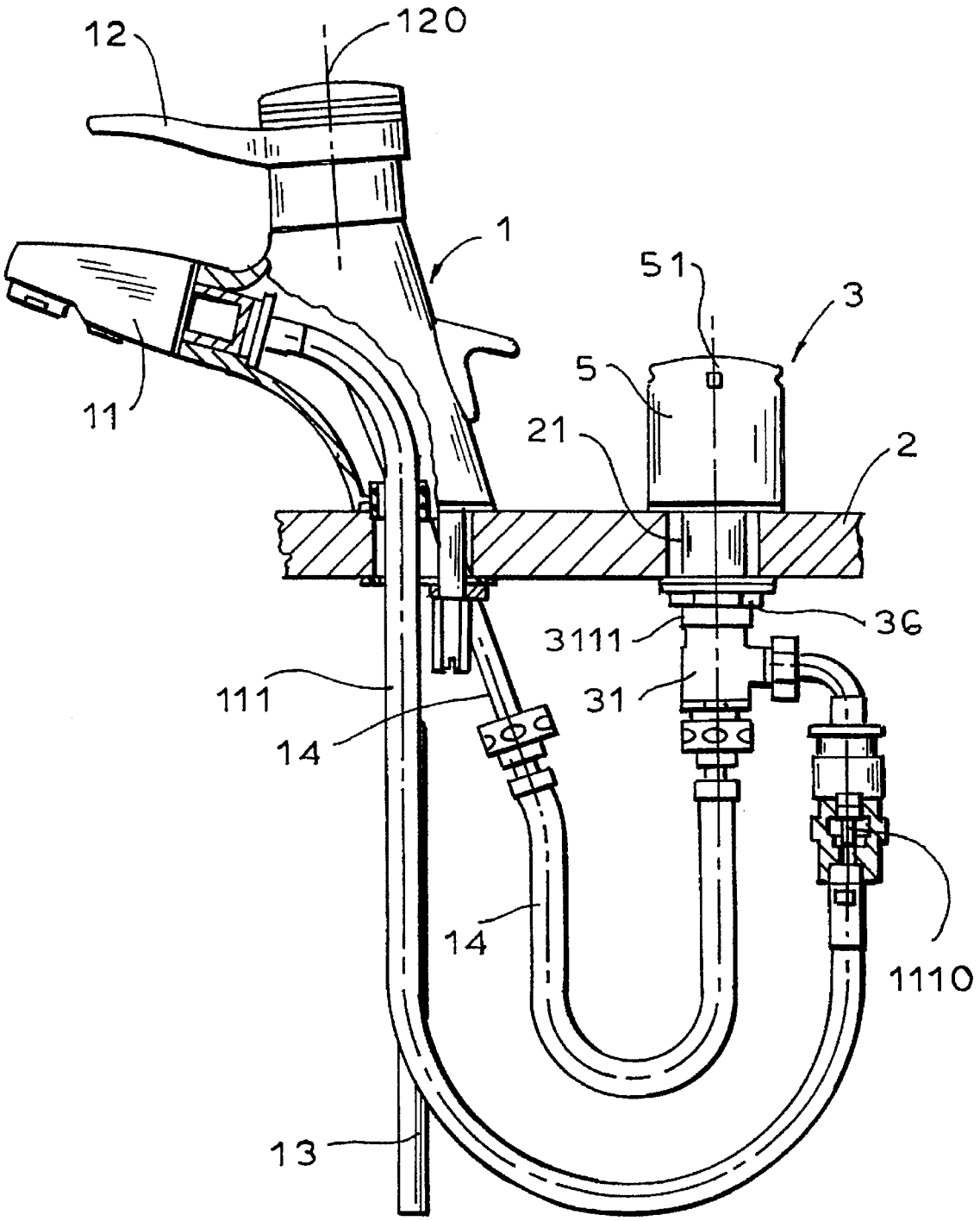
FIG. 1 is a partly sectional side view of the plumbing fixture according to the invention.

As seen in FIG. 1 a faucet 1 is mounted on a standard horizontal counter or deck 2 and is connected to hot- and cold-water inlet lines 13 and to a tempered-water output line 14. It has a faucet head 11 that is fed the tempered water via a hose 111 connected via a check valve 1110 to a vented backflow preventer 3 to which the output line 14 is connected. A handle 12 of the faucet can be tipped vertically to change the volume of flow from the head 11 and can be rotated about a faucet axis 120 to change the temperature of the outputted water. This faucet 1 is substantially standard.

Figure 2:
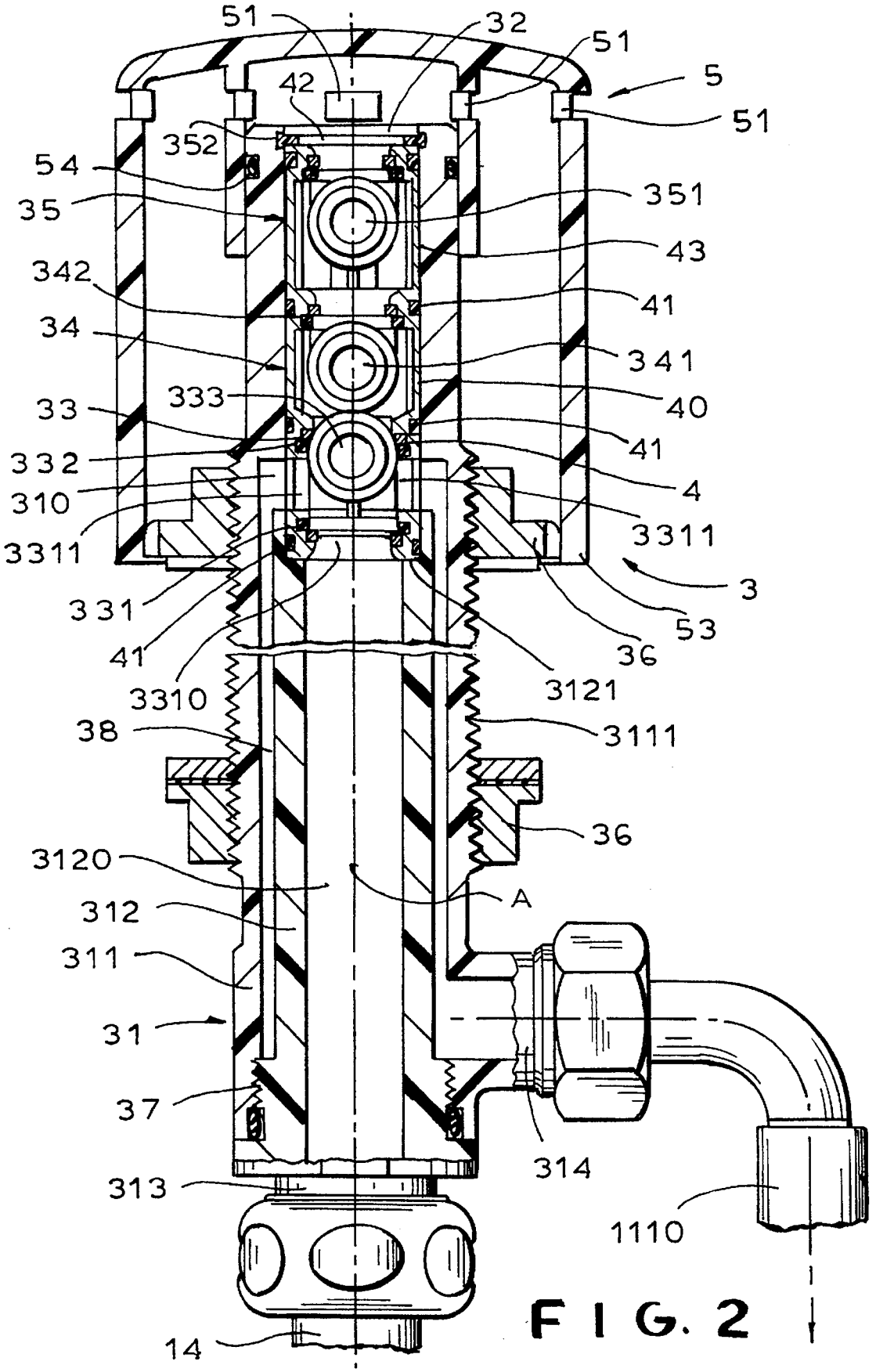
FIG. 2 is a large-scale axial section through the backflow preventer of the fixture.

The backflow preventer 3 as shown in FIG. 2 is mounted in a hole 21 in the deck 2 separate from the faucet 1. It has a housing 31 formed by an inner tube 312 centered on an upright axis A and having a lower end formed as an intake port or connection 313 to which the line 14 is connected and an outer tube 311 secured at a lower screwthread 37 to the inner tube 312, forming an outlet passage or compartment 38 with the tube 312, and formed with a lateral outlet port or connection 314 to which the valve 1110 and hose 111 are connected. Nuts 36 riding on a screwthread 3111 of the outer tube 311 clamp the housing 3i to the counter 2. The upper end of the outer tube 311 forms a vent opening 32 open to the atmosphere above the deck 2 and the outer tube 311 forms a chamber 310 around an upper end 3310 of the inner tube 312.

A lower check valve 33 has a sleeve 4 seated on a shoulder 3121 of the inner-tube upper end 3310 and forming a lower seat 331 at the upper end 3310, an upper seat 332 in the outer tube 311, and lateral openings 3311 communicating with the chamber 310. A lower-valve ball 333 between the seats 331 and 332 is made of glass or other material denser than water. In the illustrated upper position the ball 333 fits in the seat 332 and allows flow from an inlet passage or interior 3120 of the tube 312 through the holes 3311 to the chamber 38 and thence out the housing 311 while blocking any flow through the vent 32.

An upper check valve 34 directly above the valve 33 has a sleeve 40 fitted in the outer tube 311 and forming an upper seat 342 for a valve ball 341 that is made of polypropylene of other material less dense than water. Immediately above this valve 34 is another such valve 35 having a sleeve 43 and ball 351, and forming an upper seat 352. This upper valve 35 is purely used for redundancy and is not essential to the operation of the invention. Seal rings 41 are provided around the sleeves 4 and 40 and a snap ring 42 secures them all in place.

A decorative cap 5 is formed with vent holes 51 and has an inner ring 52 that is a snug fit on the upper end of the outer tube 311, with a friction ring 54 forming a tight force fit between the two. An outer wall or jacket 53 engages down to the counter 2 around the upper nut 36 to hide this structure. This cap 5 can be finished to match the faucet 1, normally being made of vacuum-plated plastic or of brass.

Under normal conditions the interior 3120 of the inner tube 312 is pressurized at high pressure so that the ball 333 is forced up into the upper seat 332. This allows free flow from the inner-tube chamber 3120 through the holes 3311 and the chamber 310 to the outer chamber 38 and thence through the valve 1110, which is in fact redundant and largely superfluous to the system, to the hose 11. The upper valve balls 341 and 351 remain in their lower positions.

If the interior 3120 is only modestly pressurized or filled slowly, the ball 333 will not be lifted much. If the spray head 11 is above the ball 341, however, water will rise in the outer tube 311 so that this ball 341 will float up and fit into the seat 342, blocking flow out of the vent 32. The second ball 351 is provided merely to prevent droplets that get past the valve 34 from exiting the system.

If a condition is created where the pressure in the interior 3120 of the tube 312 is lower than that in the hose 111, the ball 333 will be sucked down into the seat 331 and prevent flow back into the line 14. Meanwhile the balls 341 and 351 will drop down to allow air to enter the vent 32 and pass through the holes 3311 and the chamber 38 to the hose 111, allowing it to drain. Thus if the head 11 is left in a filled sink and supply-line pressure fails or is reversed, there will be no reverse siphoning of the sink water back into the supply lines. Even if there is subatmospheric pressure in the inner-tube interior 3120 and the lower valve 33 leaks somewhat, the system will draw in air, not water since the assembly is above the counter level.

We claim:

1. In combination with a plumbing fixture having a valve supplying water under pressure to an output and a hose outlet having an intake end, a vented backflow preventer comprising:

a housing separate from the valve and having an inlet port connected to the valve output and an outlet port connected to the hose intake end;

a lower check valve in the housing having a lower seat, an upper seat, and a valve body of density greater than water movable between a lower position sitting on and blocking the lower seat and an upper position sitting on and blocking the upper seat, the housing being formed with an inlet passage leading from the inlet port to the lower seat and an outlet passage leading from between the seats to the outlet port; and an upper check valve in the housing above the lower check valve and having an upper seat above the lower-valve upper seat and a valve body of a density less than water and movable between an upper position sitting on and blocking the upper-valve upper seat and an upper position clear thereof, the housing being formed with an externally open vent opening into the upper check valve above the upper seat thereof.

2. The vented backflow preventer defined in claim 1 wherein the lower valve body is a glass ball and the upper valve body is a plastic ball.

3. The vented backflow preventer defined in claim 1, further comprising a second upper check valve in the housing above the first-mentioned upper check valve and having an upper seat above the first upper-valve upper seat and a valve body of a density less than water and movable between an upper position sitting on and blocking the second upper-valve upper seat and an upper position clear thereof, the housing being formed with an externally open vent opening into the second upper check valve above the upper seat thereof.

4. The vented backflow preventer defined in claim 1 wherein each valve includes a guide sleeve fitted in the housing and forming the respective seats.

5. The vented backflow preventer defined in claim 1 wherein the housing comprises:

an outer tube forming the inlet passage and having an upper end provided with the lower-valve upper seat; and an inner tube received in the outer tube, forming therewith a chamber in turn forming the outlet passage, and having an upper end provided with the lower-valve lower seat.

6. The vented backflow preventer defined in claim 5 wherein the outer tube is provided with an external screw-thread and with nuts thereon adapted to flank a counter and secure the preventer thereto.

7. The vented backflow preventer defined in claim 1 wherein the housing is mounted on a counter adjacent the valve, the preventer further comprising a cover cap engaged over the housing and covering same down to the counter.

8. The vented backflow preventer defined in claim 7 wherein the cover cap is formed with vent holes and has an inner ring engaged snugly over the housing and an outer skirt engaging down to the counter.

9. The vented backflow preventer defined in claim 8 wherein the housing is provided with a friction ring engaging the inner ring of the cover cap.

10. The vented backflow preventer defined in claim 1 wherein the housing is made of plastic.

11. In combination with a plumbing fixture having a valve mounted on a counter and supplying water under pressure to an output and a hose outlet having an intake end, a vented backflow preventer comprising:

a housing separate from the valve and having inner tube forming an inlet port connected to the valve output and an outer tube forming an outlet port connected to a hose intake end;

a lower check valve in the housing having a lower seat in an upper end of the inner tube, an upper seat in an upper end of the outer tube, and a valve body of density greater than water movable between a lower position sitting on and blocking the lower seat and an upper position sitting on and blocking the upper seat, the inner tube forming an inlet passage leading from the inlet port to the lower seat and the tubes together an outlet passage leading from between the seats to the outlet port; and an upper check valve in the outer tube above the lower check valve and having an upper seat above the lower-valve upper seat and a valve body of a density less than water and movable between an upper position sitting on and blocking the upper-valve upper seat and an upper position clear thereof, the housing being formed with an externally open vent opening into the upper check valve above the upper seat thereof.

* * * * *